US005163390A

United States Patent [19]

Shimamoto

[11] Patent Number: 5,163,390

[45] Date of Patent: Nov. 17, 1992

[54] ROCKER ARM ARRANGEMENT FOR SINGLE CAM MULTI-VALVE ENGINE

[75] Inventor: Makoto Shimamoto, Iwata, Japan

[73] Assignee: Yamaha Hatsudoki Kabushikik Kaisha, Iwata, Japan

[21] Appl. No.: 620,061

[22] Filed: Nov. 28, 1990

[30] Foreign Application Priority Data

Nov. 29, 1989 [JP] Japan ..... 1-309473

[51] Int. Cl.[5] ..... F01L 1/02

[52] U.S. Cl. ..... 123/90.27; 123/432

[58] Field of Search ..... 123/90.22, 90.23, 90.27, 123/90.39, 90.44, 432

[56] References Cited

U.S. PATENT DOCUMENTS

| | | | |
|---|---|---|---|
| 4,766,866 | 8/1988 | Takii et al. | 123/90.27 |
| 4,796,574 | 1/1989 | Fujii et al. | 123/90.23 |
| 5,070,824 | 12/1991 | Morishita | 123/432 |

FOREIGN PATENT DOCUMENTS

| | | |
|---|---|---|
| 62-43050 | 9/1987 | Japan . |
| 64-4045 | 1/1989 | Japan . |
| 1-145907 | 10/1989 | Japan . |
| 2-40904 | 3/1990 | Japan . |
| 2-61325 | 3/1990 | Japan . |
| 2-18603 | 7/1990 | Japan . |
| 3-15623 | 1/1991 | Japan . |

*Primary Examiner*—Noah P. Kamen
*Attorney, Agent, or Firm*—Ernest A. Beutler

[57] ABSTRACT

A single overhead cam multi-valve internal combustion engine wherein individual rocker arms operate each of at least three intake valves and two exhaust valves so as to permit adjustment in the lift and timing of the respective valves. A spark plug well is formed in the cylinder head between the exhaust valves to provide accessibility and maintain a compact assembly. Various bearing arrangements are disclosed for journaling the camshafts.

27 Claims, 8 Drawing Sheets 43
4
3
5

ROCKER ARM ARRANGEMENT FOR SINGLE CAM MULTI-VALVE ENGINE

BACKGROUND OF THE INVENTION

This invention relates to a rocker arm arrangement for a single cam multiple valve engine and more particularly to an improved, compact rocker arm arrangement for operating multiple valves of an engine from a single camshaft and permitting varying degrees of lift and valve events for the valves.

The use of multiple valves for a single combustion chamber of an internal combustion engine has been acknowledged to provide an increase power output for the engine in relation to a given displacement. However, when multiple valves are employed, there becomes considerable difficulty in both the placement and actuation of the valves. In one widely use form of multiple valve engine, there are provided a pair of camshafts each of which operates all of the intake or exhaust valves. Such engines are normally called DOHC engines. This type of engine permits a fairly wide latitude in valve placement and valve events. Also, it accommodates providing different valve events or different lifts for the individual valves operated by each camshaft since each valve is normally operated by its own lobe. However, this type of engine is bulky and can be expensive.

Another type of multiple valve engine (SOHC) uses a single overhead mounted camshaft for operating all of the valves. Normally, a series of rocker arms are provided for operating the intake and exhaust valves from the single overhead mounted cam. However, in addition to the positioning of the camshaft and valve actuating, it is also necessary to position one or more spark plugs for each combustion chamber in the cylinder head. This further complicates the engine construction.

In order to provide a more compact and simpler assembly, it has been proposed to operate more than one valve from a single rocker arm. Such an arrangement, obviously, provides simplification of the engine. However, when more than one valve is operated by a single rocker arm then the valves that are commonly actuated normally must have the same valve events and the same valve lift. Although the lift may be varied slightly by changing the length of the portions of the rocker arms that engage the individual valves, there are limitations to such variations. In addition, the use of such compound rocker arms results in expensive rocker arm cost due to the difficulty in forming such complicated rocker arm configurations.

It is, therefore, a principal object to this invention to provide an improved rocker arm arrangement for operating multiple valves of a single overhead camshaft engine.

It is a further object to this invention to provide an improved and compact assembly for operating multiple valves of a single overhead camshaft engine while permitting latitude in the individual events of the various valves.

It is a further objection to this invention to provide a compact and yet versatile single overhead cam multiple valve engine.

SUMMARY OF THE INVENTION

This invention is adapted to be embodied in a cylinder head and valve arrangement for an overhead valve engine that comprises a cylinder head forming in part a combustion chamber. Three poppet type intake valves are supported for reciprocation by the cylinder head generally on one side of the combustion chamber. Two poppet type exhaust valves are supported for reciprocation relative to the cylinder head generally on the other side of the combustion chamber. A camshaft is journaled for rotation about an axis extending transversely across the center portion of the combustion chamber. A pair of spaced apart exhaust rocker arms each operated by the camshaft are each associated with a respective one of the exhaust valves for operating the exhaust valves. Three intake rocker arms are disposed generally between the exhaust rocker arms in the direction of the camshaft axis and are each operated by the camshaft and each is associated with a respective one of the intake valves for operating the intake valves.

DETAILED DESCRIPTION OF THE PREFERRED EMBODIMENTS OF THE INVENTION

Figure 1:
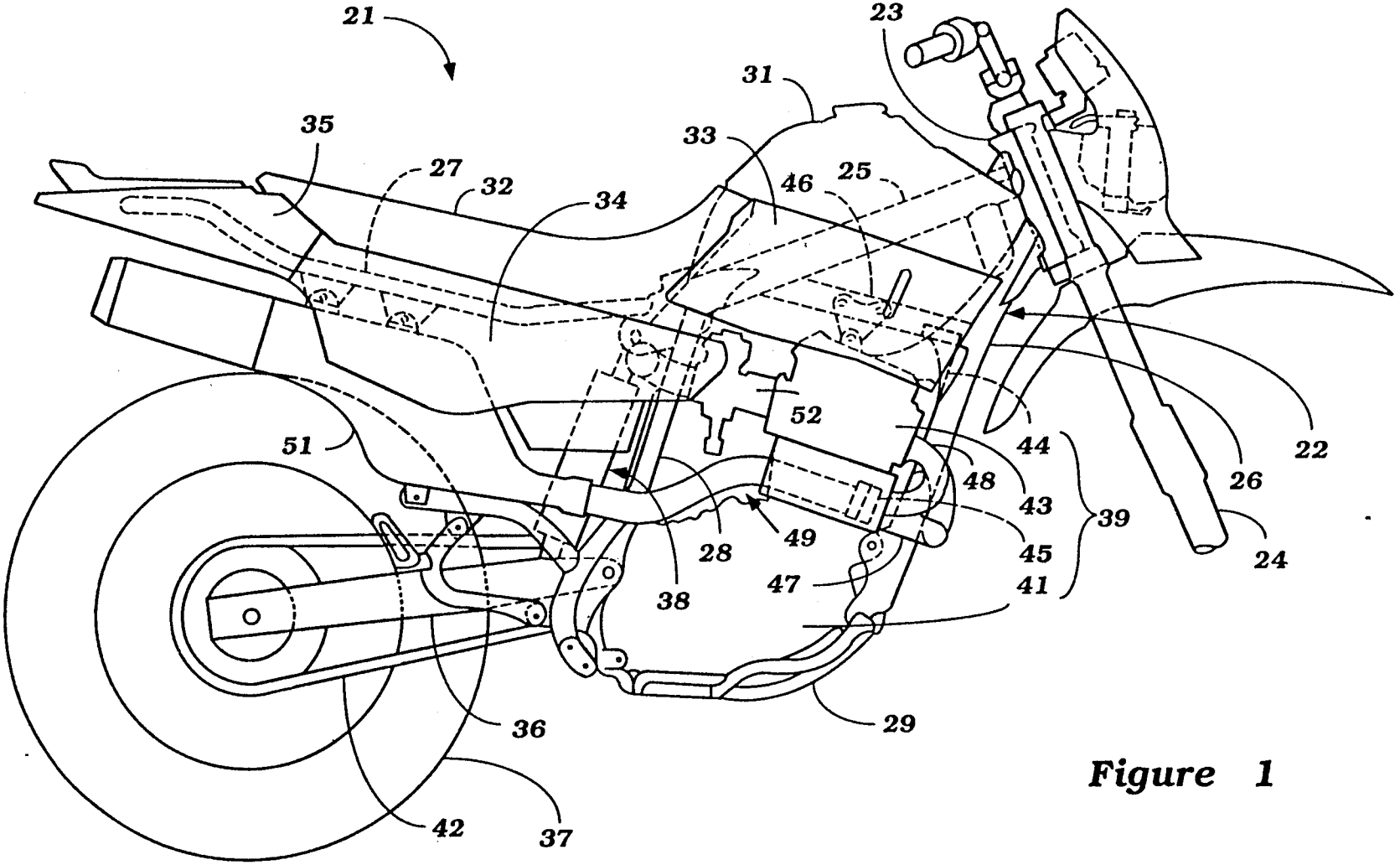
FIG. 1 is a partial side elevational view of a motorcycle powered by an internal combustion engine constructed in accordance with a first embodiment of the invention.
Figures 2, 5:
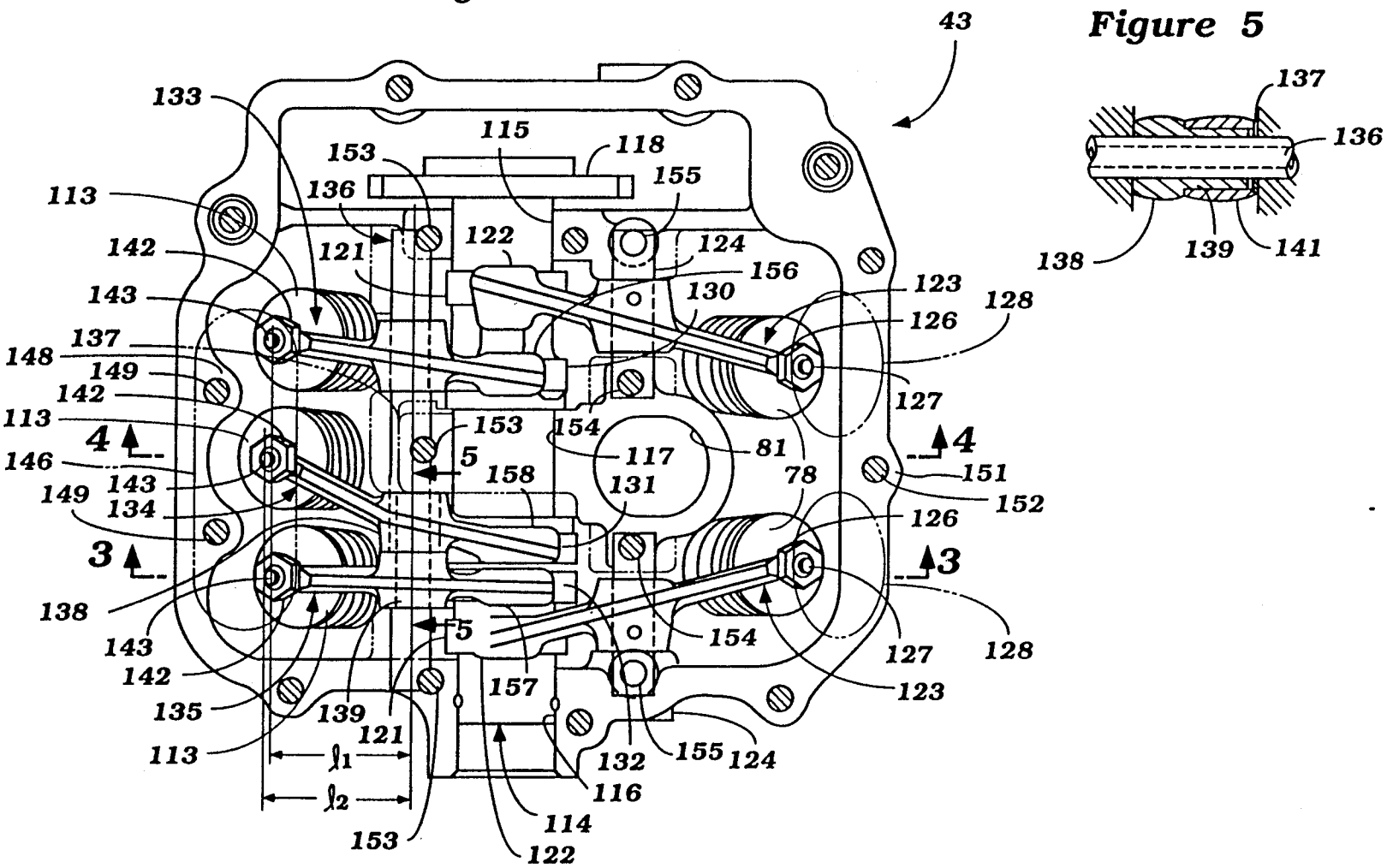
FIG. 2 is a top plan view, showing the cylinder head assembly of the engine, with the cam cover removed.
FIG. 5 is a cross sectional view taken along the line 5—5 of FIG. 2.

Referring first to FIG. 1, a motorcycle powered by an internal combustion engine constructed in accordance with an embodiment of the invention is identified generally by the reference numeral 21. The invention is described in conjunction with a motorcycle since it has particular utility in conjunction with such this type of vehicle. It is to be understood, however, that certain facets of the invention may be utilized in conjunction with internal combustion engines that power other types of vehicles or, for that matter, other applications for internal combustion engines.

The motorcycle 21 includes a welded frame assembly 22 having a head pipe 23 that journals a front fork 24 for steering movement. A front wheel (not shown) is journaled by the front fork 24 in a known manner.

The frame 22 further includes a main frame tube 25, a down tube 26, a seat rail 27 and a seat pillar 28. At the lower end of the frame, an underguard 29 spans the down tube 26 and the seat pillar 28.

A fuel tank 31 is positioned behind the head pipe 23 and ahead of a seat 32 that is carried by the seat rail 27. A small body assembly comprised of a side cover for the tank 31 and air scoop 33, a side covering for the lower portion of the seat 34 and a rear cover 35 are suitably affixed to the frame 22.

A trailing arm 36 suspends a rear wheel 37 from the frame assembly in a suitable manner, including a combined spring shock absorber 38 that lies generally on the longitudinal center plane of the motorcycle 21.

The rear wheel 37 is powered by an engine unit 39 which is comprised of a water cooled, single cylinder, four cycle, five valve, single overhead cam engine. A crankcase assembly 41 of the engine unit 39 contains a change speed transmission which is driven by the engine crankshaft and which drives the rear wheel 37 through a chain 42. Although the details of the engine unit 39 and specifically the engine portion of it will be described by references to the remaining figures, the engine unit 39 includes a cylinder head 43, a cam cover 44 and a cylinder block 45 in addition to the crankcase 41. This engine unit is mounted in the frame 22 with the cylinder block 45 inclined slightly forward in a suitable manner by means including a support pipe 46 that is positioned beneath the main pipe 25 and which is joined to the main pipe 25 and the down tube 26.

As will become apparent, the engine unit 39 has a pair of forwardly facing exhaust ports from which a pair of exhaust pipes 47 and 48 extend into an exhaust system, indicated generally by the reference numeral 49 and which includes a side mounted muffler 51.

The engine unit 39 also includes an induction system including an air box (not shown) that supplies air to a pair of carburetors 52 which serve three rearwardly facing exhaust ports, as will be described by reference to the remaining figures.

Figure 3:
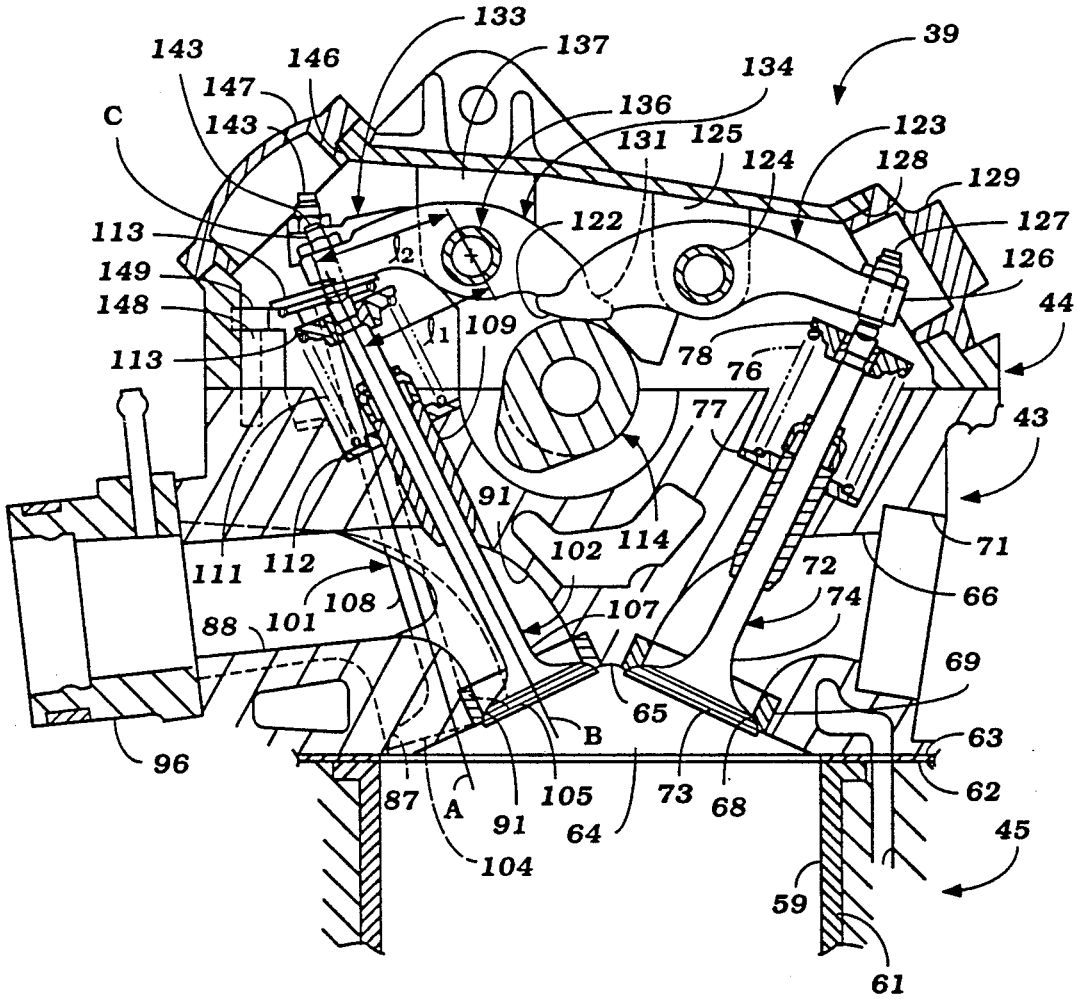
FIG. 3 is a cross sectional view of the complete cylinder head assembly and a portion of the associated cylinder block taken along the line 3—3 of FIG 2.
Figure 4:
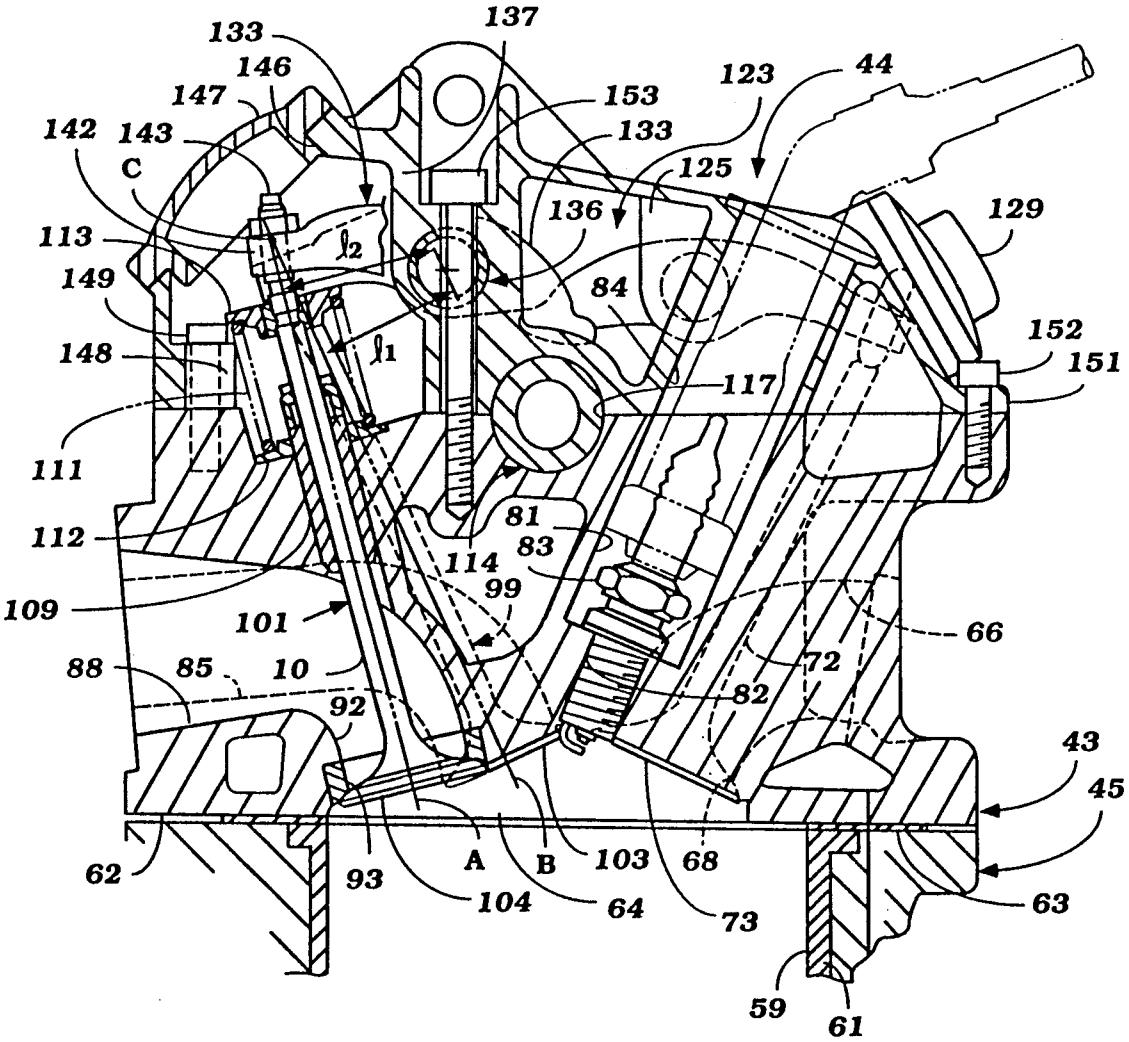
FIG. 4 is a cross sectional view taken along the line 4—4 of FIG. 2.
Figure 6:
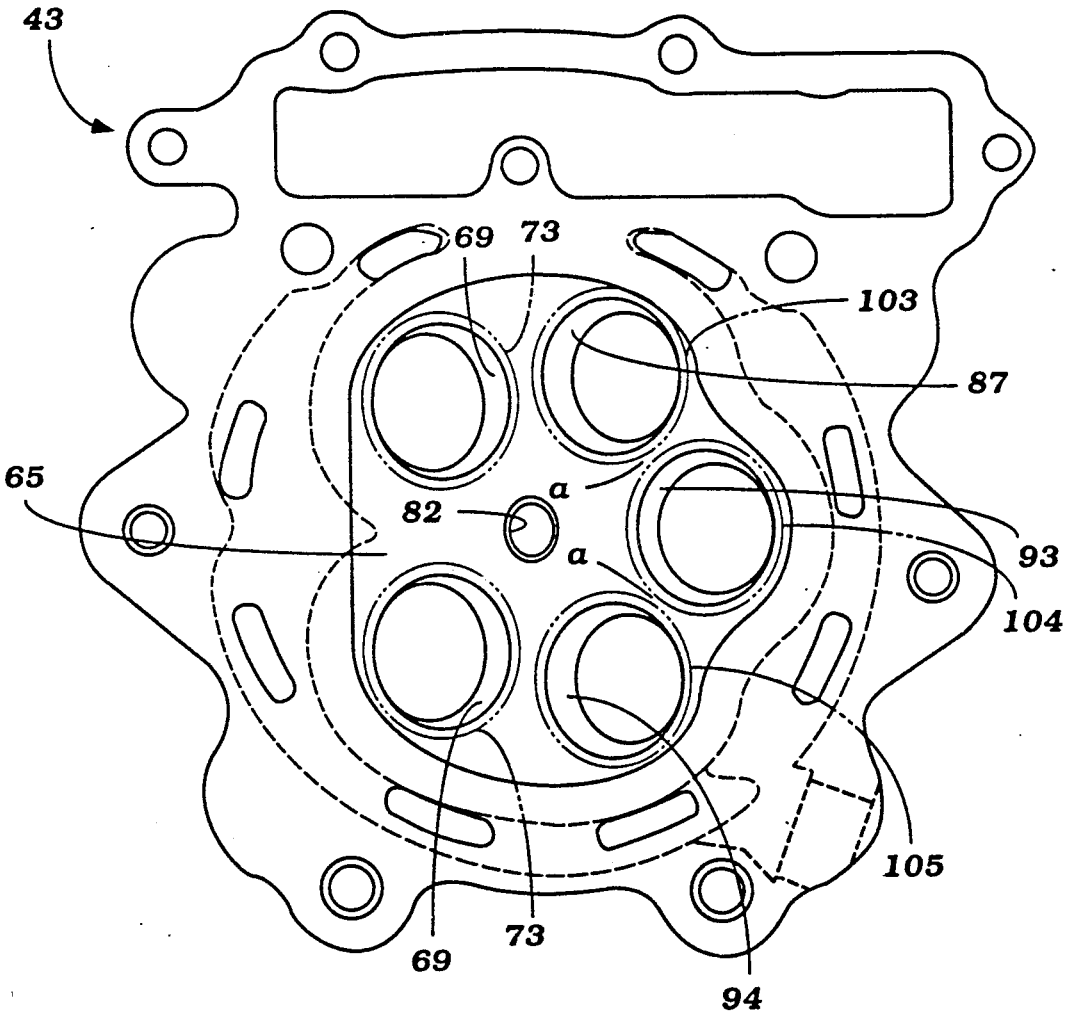
FIG. 6 is an inverted plan view of the cylinder head with the valves and spark plug removed.

Referring now to FIGS. 3 and 4, it will be noted that the cylinder block 45 is formed with a cylinder bore 59 which is formed by a pressed or cast in liner 61. A piston (not shown) reciprocates within the cylinder bore 59 and drives the crankshaft (not shown) contained within the crankcase 41 in a well known manner. Since the invention deals primarily with the cylinder head 43 and valve train associated with it, those components of the engine which are considered to be conventional have not been illustrated and further description of them is not believed to be necessary to enable those skilled in the art to practice the invention.

The cylinder head 43 has a lower surface 62 that is sealingly engaged with a head gasket 63 so as to provide a seal with the cylinder block 45 around the cylinder bore 59. In addition, the cylinder head 43 is formed with a generally central recess 64 which recess is defined by a surface 65 surrounded by the lower cylinder head surface 62. This recess has a generally spherical configuration although it assumes a pent roof type of configuration as may be best seen in FIGS. 3 and 4.

Referring now primarily to FIGS. 2 through 6, the cylinder head 43 is formed with a pair of forwardly facing exhaust passages 66 each of which extends from the combustion chamber 66 through a valve seat 64 formed by a pressed in insert 69. These exhaust passages 66 terminate in forwardly facing exhaust ports 71 to which the respective exhaust pipes 47 and 48 are affixed in a suitable manner.

A pair of exhaust valves 72 each of which has a head portion 73 and a stem portion 74 are slideably supported for reciprocation within the cylinder head 43 by a respective pressed in valve guide 75. The exhaust valves 72 reciprocate within a common plane that is inclined at an acute angle to a plane containing the axis of the cylinder bore 59. The axes of reciprocation also lie in planes that are parallel to each other and to the cylinder bore axis. This facilitates operation of the valve although they may be slightly inclined if desired. The exhaust valves 72 are urged to their closed positions by means of respective coil compression springs 76 that engage wear plates 77 bearing against the cylinder head 43 and keeper retainer assemblies 78 affixed in a known manner to the upper ends of the exhaust valve stems 74. The exhaust valves 72 are opened in a manner which will be described.

It should be noted that the exhaust passages 66 and 67 are disposed at an angle to the plane containing the cylinder bore axis D and thus diverge from a plane perpendicular to this plane and also passing through the cylinder bore axis. This permits the exhaust pipes 47 and 48 to clear the down tube 26 and also provides a better and less flow resistant path for the entire exhaust system.

A spark plug well 81 (FIG. 4) is formed in the cylinder head 43 between the exhaust passages 66 and terminates at a threaded opening 82 in which a spark plug 83 is received. The spark plug 83 is disposed so that its gap lies substantially on the cylinder bore axis. A corresponding well 84 is formed in the cam cover 44 so as to facilitate insertion and removal of the spark plug 83 without removing the cam cover 44. The spark plug 83 is fired by a suitable ignition system.

Figure 7:
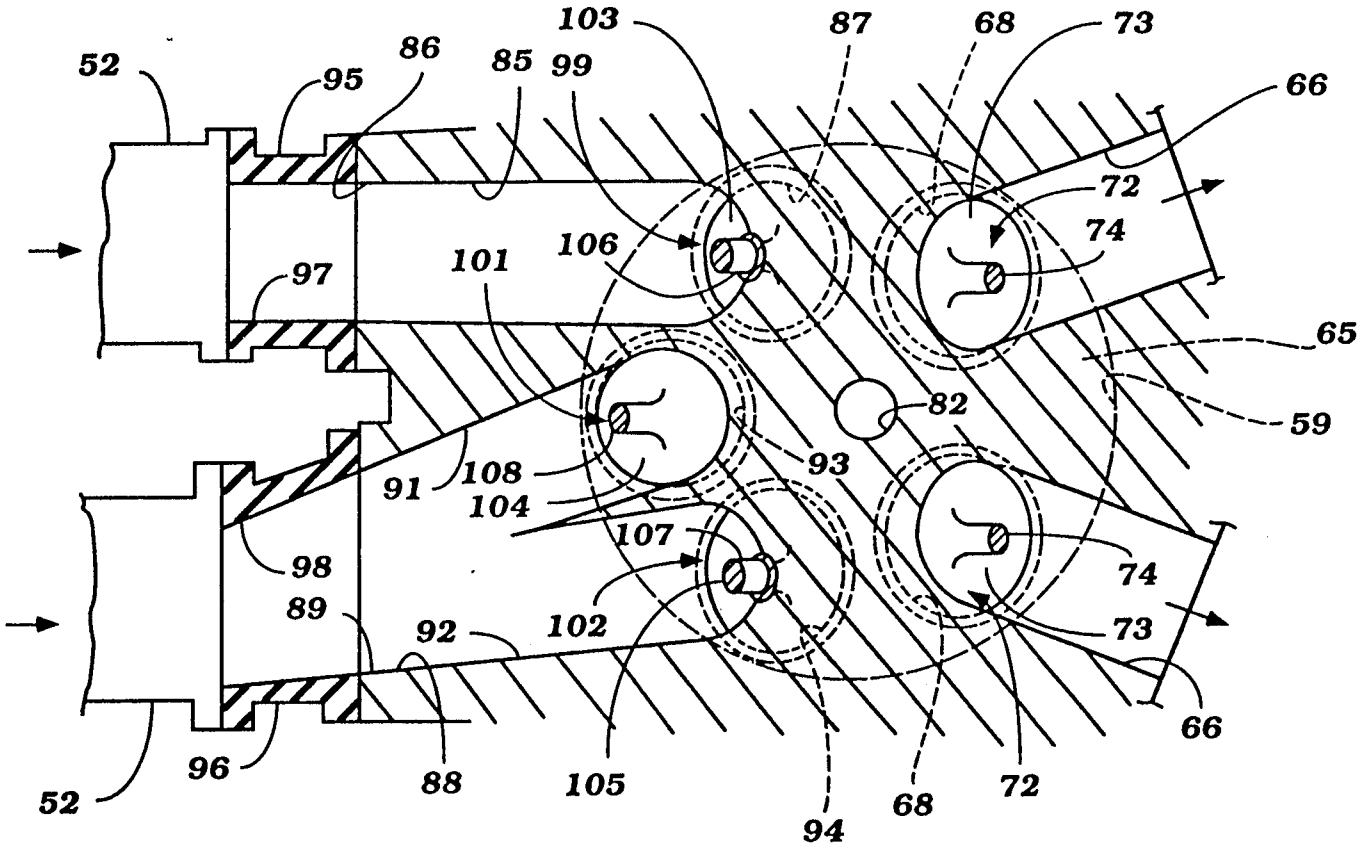
FIG. 7 is a cross sectional view of the cylinder head taken through the intake and exhaust ports to show the configuration of their passages.

A primary intake passage 85 extends through the opposite side of the cylinder head 43 from the exhaust side already described. The passage 85 extends from an intake port 86 formed in the side of the cylinder head 43 and terminates at a valve seat 87 formed by a pressed in insert. As may be best seen in FIG. 7, the primary intake passage 85 has a central axis that is generally perpendicular to the aforenoted plane containing the cylinder bore axis and hence as a relatively short length from its intake port 86 to its valve seat 87. As a result, good, low and mid range performance and good response may be achieved. A siamese type secondary intake passage 88 extends from an intake port 89 formed in the intake side of the cylinder head 43 and branches into a pair of passages 91 and 92 each of which terminates at a respective valve seat comprised of a center valve seat 93 and a side valve seat 94. The center of the intake port 89 as extended by a spacer, to be described, is disposed at the same distance from a plane perpendicular to the cylinder bore axis perpendicular to the aforementioned plane as the port 86, as extended. The carburetors 52 are affixed to these respective intake ports 86 and 89 through the intermediary of respective spacers 95 and 96 which have respective passage ways 97 and 98 that form extensions of the cylinder head intake passages 85 and 88. By utilizing the spacers it is possible to have this equal distance between the centers of the ports even though the actual port 89 is closer to the perpendicular plane than is the inlet of the passage 98 and its spacer. This construction permits the induction system to clear the shock absorber and spring assembly 38 and avoids interference between the carburetors 52.

A central effective line or bisector of the secondary intake passage 88 lies at an acute angle to the perpendicular plane while the portion 92 extends generally perpendicularly to the plane containing the axis of the cylinder bore as aforenoted. As a result, the intake passages serving the side valve seats 87 and 94 are relatively short while the passage 91 is somewhat longer. This variation in length can be employed so as to achieve the desired flow pattern in the engine.

The carburetor 52 that serves the intake passage 85 is sized and jetted and has a throttle valve (not shown) that functions to control both the low speed and mid range performance of the engine as well as the high speed performance. The throttle valve (not shown) of the carburetor 52 that serves the secondary passage 88 is operated in a staged sequence with the primary carburetor and may only have high speed circuits since this carburetor supplies the fuel air charge only to the engine under high speed operation. Either a staged linkage system or some form of load or speed responsive control (such as a vacuum responsive servo motor) can be employed for operating the throttle valve of the secondary carburetor 52 in this staged sequence.

First, second and third poppet type intake valves 99, 101 and 102 have respective head portions 103, 104 and 105 which cooperate with the valve seats 87, 93 and 94 for controlling the flow through them. The intake valves 99 and 102 are side valves and have their respective stem portions 106 and 107 slidable supported in guides, to be described, for reciprocation about axes B which are in a common plane disposed at an acute angle to the plane containing the cylinder bore axis which acute angle may be substantially the same as the acute angle of reciprocation of the exhaust valves 72. The center exhaust valve 101 has its stem portion 108 supported for reciprocation about an axis A which is disposed also at an acute angle to the aforenoted plane containing the cylinder bore axis but which acute angle is lesser than the angle of reciprocation B of the valves 99 and 101. The angular disposition of the reciprocal axes A and B is such that these axes intersect a line C which is parallel to the plane containing the cylinder bore axis but which is spaced from the tips of the individual intake valves 99, 101 and 102. As a result of this, the angular configuration of the side valves 99 and 102 relative to the center valve 101 is relatively small. This configuration permits the adjacent area between the intake valves as indicated at "a" in FIG. 6 to be relatively smooth and thus provide a smooth combustion chamber configuration that will avoid hot spots and still permit a generally spherical configuration.

The axes A and B of reciprocation of the intake valves 101 and 99 and 102 all lie in parallel planes which planes are parallel to the axis of the cylinder bore. This permits ease of operation. However, if desired, these axes may be slightly skewed from parallel planes as is also possible with the exhaust valve 72, as previously noted.

The valve guides that slidable support the stems 106, 107 and 108 of the intake valves 99, 102 and 101 are each indicated by the reference numeral 109. Intake valve springs 111 engage bearing plates 112 that bear against the cylinder head 43 and keeper retainer assemblies 113 affixed to the upper ends of the respective valve stems for urging the intake valves 99, 101 and 102 to their closed positions. The intake valves 99, 101 and 102 are operated by means of rocker arm assemblies to be described.

The exhaust valves 72 and intake valves 99, 101 and 102 are all operated by means of a single overhead camshaft 114. The camshaft 114 is journaled, in a manner to be described, for rotation about an axis which is offset to the intake side of the cylinder head from the cylinder bore axis. This axis is parallel to the plane aforementioned that contains the axis of the cylinder bore. The camshaft 114 has end bearing surfaces that are journaled in bearing surfaces 115 and 116 (FIG. 2) formed by the cylinder head 43 and corresponding bearing surfaces formed by the cam cover 44. In addition, there is provided a central bearing surface on the camshaft 114 that is journaled by a bearing surface 117 formed in the cylinder head 43. A corresponding bearing surface is partially formed in the cam cover 44 and has its center offset a distance from the cylinder bore axis so as to provide clearance for other components of the cylinder head assembly to be described and specifically one of the rocker arms.

The camshaft 114 is driven from the engine crankshaft by means of a drive chain (not shown) and sprocket 118 that is affixed to one end of the camshaft.

A pair of exhaust cam lobes 121 are formed at the outer ends of the camshaft 114 adjacent the bearings that engage the cylinder head bearing surfaces 115 and 116. These cam lobes 121 are engaged by follower surfaces 122 of exhaust rocker arms 123. These exhaust rocker arms 123 are journaled on stub rocker arm shafts 124 each of which is supported by a boss 125 formed on the inner surface of the cam cover 44.

The outer ends of the rocker arms 123 are provided with taped portions 126 that receive adjusting screws 127 for providing lash adjustment between the exhaust rocker arms 123 and the tips of the stems 74 of the exhaust valves 72 for clearance adjustment. Access openings 128 are provided in the cam cover 44 for facilitating valve adjustment without removal of the cam cover 44. These access openings 128 are normally closed by closure plugs 129 which are affixed in place in a suitable manner.

In addition to the exhaust cam lobes 121, the camshaft 114 is provided with a first intake cam lobe 130 that is disposed between the center bearing surface of the camshaft 114 and the exhaust cam lobe 121 adjacent the bearing surface of the camshaft journaled in the cylinder head bearing surface 11 . In addition, a pair of intake cam lobes 131 and 132 are disposed between the center bearing surface of the camshaft 114 and the exhaust cam lobe 121 adjacent the cylinder head bearing surface 116. First 133 second, 134 and third 135 rocker arm assemblies are each journaled upon a single intake rocker arm shaft 136 which is fixed in lugs formed on the cam cover 44. These lugs may be the same lugs as form the bearing surfaces which cooperate with the cylinder head bearing surfaces 115, 116 and 117. The center of these lugs appears in FIGS. 3 and 4 and is indicated generally by the reference numeral 137.

It should be noted that the bearing portion of the intake rocker arm 134, which operates the center intake valve 101, which bearing portion is indicated by the reference numeral 138 has an extended portion 139 which receives and journals the bearing portion 141 of the rocker arm 135. This arrangement provides greater stabilization for the center rocker arm 134 which is important due to its angular configuration, as will be described.

It has already been noted that the intake valves 99 and 102 reciprocate about respective reciprocal axes B and the intake valve 101 reciprocates about the axis A. As has been noted that the axes A and B intersect at a line C which is parallel to the aforenoted plane containing the cylinder bore axis which point C is spaced from the tips of all of the intake valves. However, the center intake valve 101 has its tip disposed at a somewhat higher point from the lower cylinder head surface 62 and also spaced outwardly in a horizontal direction a greater distance 12' than the tips of the side intake valves 99 and 102 which valves lie at the distance 11' from the plane and also from the pivotally axes of the respective rocker arms defined by the rocker arm shaft 136. Also, it should be noted that the center intake valve 101 and specifically its axis B is at a perpendicular distance 11 from the rocker arm shaft 136 whereas the axes of reciprocation A of the other intake valves is a perpendicular distance 12 from this axis. This distance 11 is less than the distance 12. These differences in distance permit the smooth combustion chamber configuration previously noted. Each of the rocker arms 133, 134 and 135 is provided With an enlarged taped portion 142 that receives a respective adjusting screw 143 for cooperation with the tip of the actuated valve for lash adjustment. The cam cover 44 is provided with elongated opening 146 for accessing each of the adjusting screws 143 so that the valve adjustment may be made without removing the cam cover. A removal closure plug 147 normally closes the opening 146 and is removed for servicing.

The cam cover 44 is affixed to the cylinder head 43 by a plurality of fasteners, most of which are accessible from externally of the cam cover 44. However, the cam cover 44 is provided with an inwardly extending bosses 148 (FIGS. 2–4) into which threaded fasteners 149 are received for affixing the cam cover 44 to the cylinder head 43. These fasteners 49 are readily accessible through the service opening 146 when the cover 147 is removed. A corresponding lug 151 is formed on the exterior of the cam cover 44 between the two exhaust rocker arms and is secured to the cylinder head 43 by a threaded fastener 152. Further threaded fasteners, indicated by the reference numerals 153 not only serve to hold the cam cover 44 to the cylinder head 43 but also serve to prevent rotation of the rocker arm shaft 136. Other threaded fasteners 154 serve to hold the cam cover 44 to the cylinder head 43 and also serve to prevent rotation of the rocker arm shafts 124. Further threaded fasteners 155 are fastened into the cam cover and serve only the purpose of preventing rotation of the rocker arm shafts 124.

The rocker arms 133 and 135 have respective follower portions 156 and 157 that engage the cam lobes 124 and 132, respectively. These rockers arms extend in a generally straight direction from the follower portions 156 and 157 to their adjusting screw ends 142. The rocker arm 134, on the other hand, has a follower portion 158 that engages the cam lobe 131 and which extends generally straight to its journal on the rocker arm shaft 136 and then bends to its end 142 that receives the adjusting screw 143. This configuration is to Clear the lugs 137 of the cam cover 44 that provides the center bearing for the camshaft 114. It is this bent shape that requires the long bearing surface for this rocker arm 134, as aforenoted.

Figure 8:
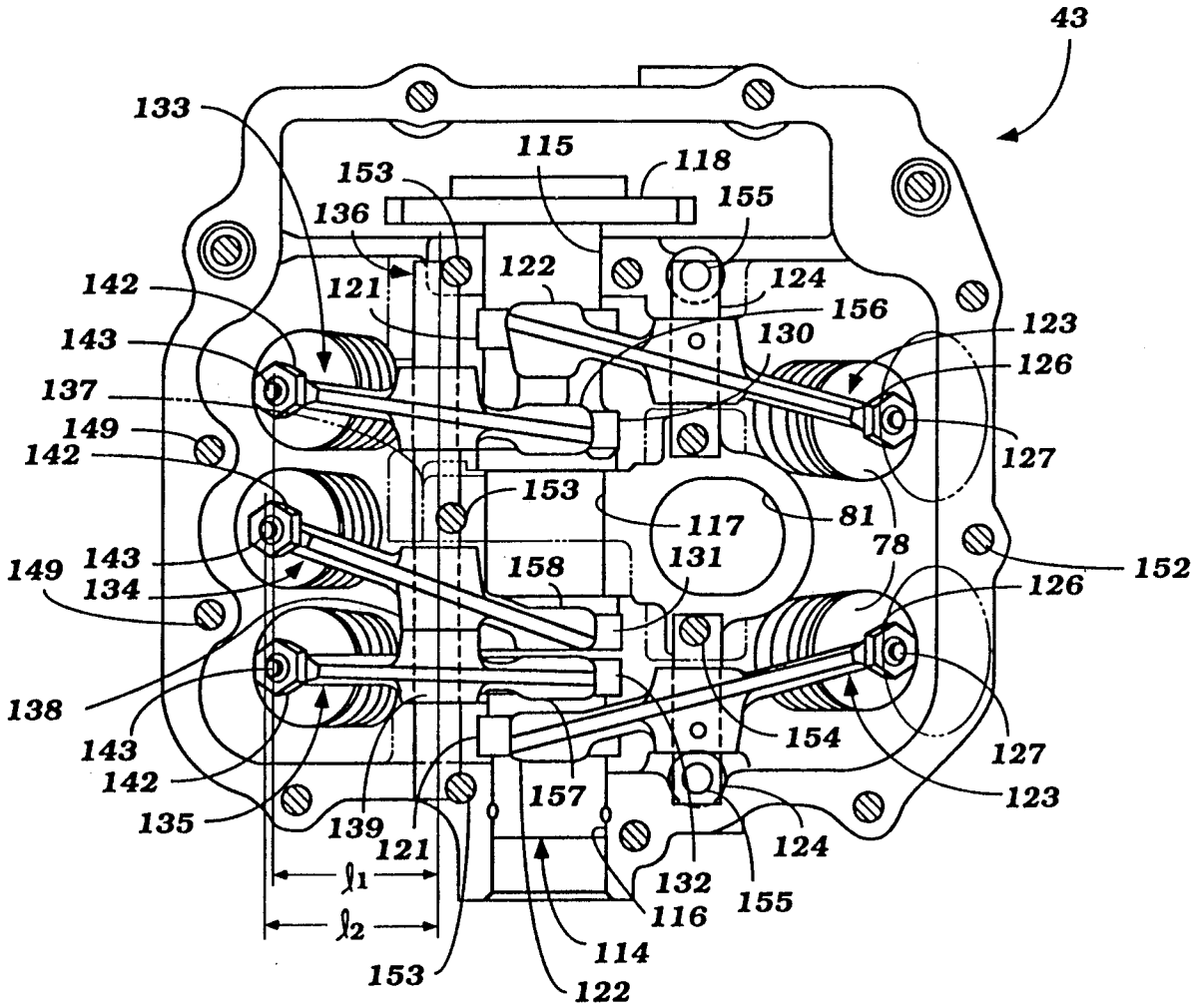
FIG. 8 is a top plan view, in part similar to FIG. 2, of another embodiment of the invention.

FIG. 8 shows an embodiment of the invention which is generally similar to the embodiment of FIGS. 1 - 7 and, for that reason, components of this embodiment which are the same as the previously described embodiment have been identified by the same reference numerals. However, it should be noted that in this embodiment the center intake rocker arm 134 extends generally straight from its follower portion 158 to its adjusting end portion 142 that carries the adjusting screw 143. This is permitted by slightly offsetting or notching the bearing portion formed by the lug 137 of the cam cover 44 as seen in FIG. 8.

Figure 9:
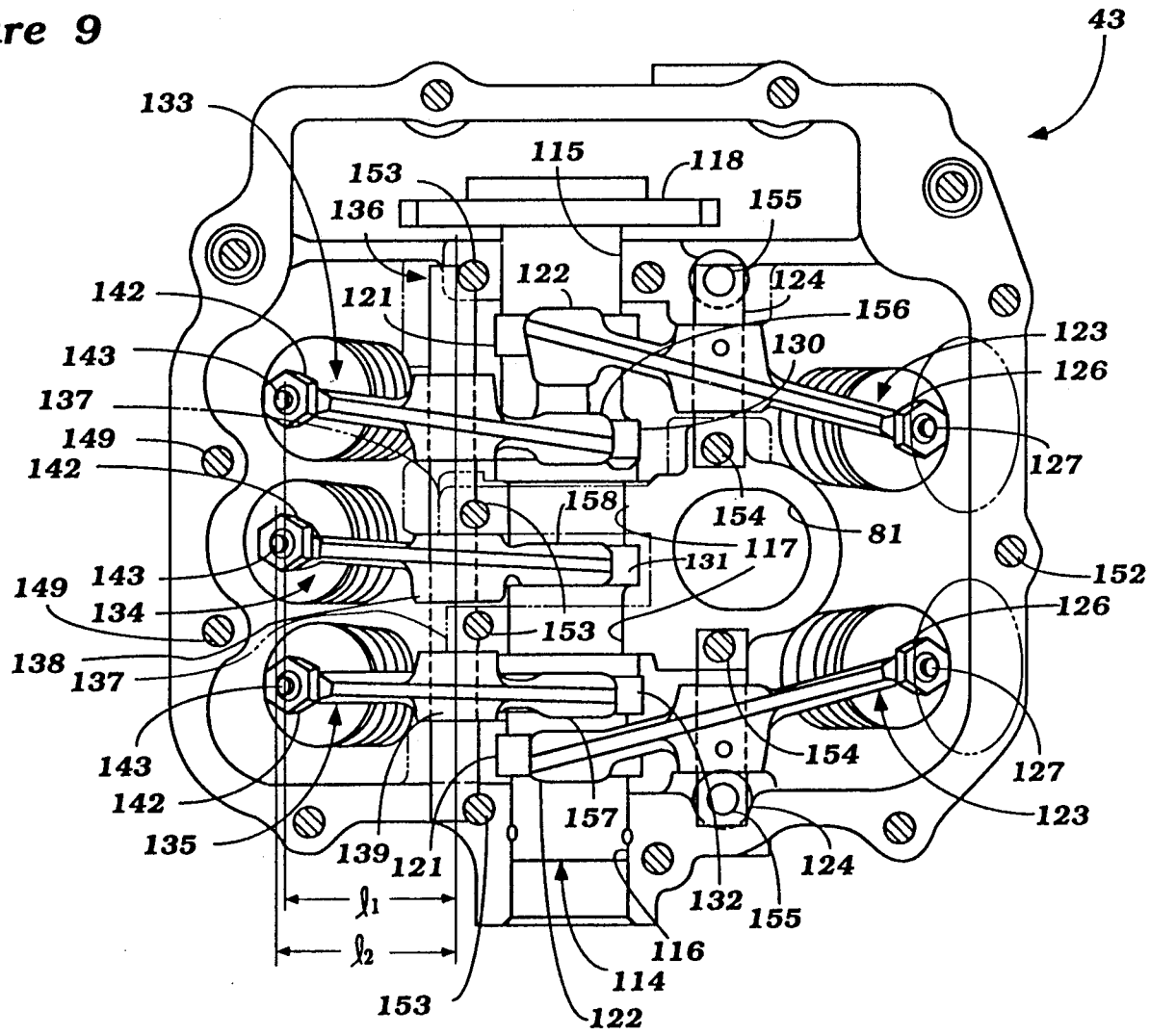
FIG. 9 is a top plan view, in part similar to FIGS. 2 & 8, showing yet another embodiment of the invention.

FIG. 9 shows another embodiment of the invention which permits the use of relatively straight rocker arms 133, 134 and 135 for operating the individual intake valves. This is camshaft 114 into two spaced apart bearing surfaces and placing the intake cam lobe 131 between the split bearing portions. In all other regards, this embodiment is the same as those previously described and, for this reason, the same reference numerals have been utilized to identify the same or similar components.

The invention has been described in conjunction with a single cylinder engine. Obviously, the concept of the invention can be readily practiced in conjunction with multiple cylinder engine of variety of configurations such as incline, opposed or V-type.

It should be readily apparent from the foregoing description that the described embodiments provide an extremely compact cylinder head arrangement in which multiple valves are operated by a single overhead mounted camshaft. However, the valve actuating system permits the valve events and lift of the individual valves to be designed as desired through the use of separate actuators for each valve. Of course, the foregoing is only a description of preferred embodiments of the invention and various changes and modifications may be without departing from the spirit and scope of the invention as defined by the appended claims.

I claim:

1. A cylinder head and valve arrangement for an overhead valve engine comprising a cylinder head forming in part a combustion chamber, three poppet type intake valves supported for reciprocation by said cylinder head generally on one side of said combustion chamber, two poppet type exhaust valves supported for reciprocation relative to said cylinder head generally on the other side of said combustion chamber, a camshaft journaled for rotation about an axis extending generally across the center of said combustion chamber, a pair of spaced apart exhaust rocker arms each operated by said camshaft and associated with a respective one of said exhaust valves for operating said exhaust valves, and three separate intake rocker arms each being disposed generally between said exhaust rocker arms in the direction of said camshaft axis and each operated by said camshaft and associated with a respective one of said intake valves for operating said intake valves.

2. A cylinder head and valve arrangement as set forth in claim 1 wherein the camshaft is provided with a separate lobe for actuating each of the rocker arms.

3. A cylinder head and valve arrangement as set forth in claim 2 wherein the camshaft is provided with a pair of spaced apart bearing surfaces each positioned axially outwardly from the cam lobes that actuate the exhaust valves.

4. A cylinder head and valve arrangement as set forth in claim 3 wherein the camshaft is further supported by a third bearing surface formed between the cam lobes that operate two of the intake valves.

5. A cylinder head and valve arrangement as set forth in claim 4 wherein at least one of the intake rocker arms extends in a plane perpendicular to a plane containing the cylinder bore axis from its respective cam lobe to the valve actuated thereby and wherein the exhaust rocker arms extends at an acute angle to said plane from the cam lobes which actuate them to the exhaust valves operated thereby.

6. A cylinder head and valve arrangement as set forth in claim 4 wherein one of the rocker arms has a portion that extends generally straight from the cam lobe to its journal portion on a rocker arm shaft and a second portion that extends at an angle from the rocker arm shaft journal to the valve actuated thereby.

7. A cylinder head and valve arrangement as set forth in claim 2 further including a second pair of bearing surfaces formed on the camshaft between the lobes that actuate the intake rocker arms.

8. A cylinder head and valve arrangement as set forth in claim 2 wherein the cam shaft is journaled for rotation by a bearing surface formed between a pair of cam lobes that operate two of the intake valves.

9. A cylinder head and valve arrangement as set forth in claim 8 wherein the cam shaft is driven at one end thereof.

10. A cylinder head and valve arrangement as set forth in claim 9 wherein the cam shaft bearing surface is separated from the driven end of the cam shaft by only one cam lobe that operates an intake valve with the cam lobes that operate the remaining intake valves being positioned on the other side of the bearing surface from the driven end of the cam shaft.

11. A cylinder head and valve arrangement as set forth in claim 8 wherein the means for rotatably journaling the cam shaft comprises a pair of bearing surfaces formed on the cam shaft each between a pair of cam lobes that operate the intake valve.

12. A cylinder head and valve arrangement as set forth in claim 8 wherein a rocker arm a operating one of the intake valves from the cam lobe adjacent the bearing surface has a portion that extends generally straight from said cam lobe to its journal portion on a second rocker arm shaft and a second portion that extends at an angle from the rocker arm shaft in a direction toward the bearing surface for operating an intake valve positioned in axially alignment with the bearing surface.

13. A cylinder head and valve arrangement as set forth in claim 1 wherein the intake rocker arms are all journaled on a common rocker arm shaft.

14. A cylinder head and valve arrangement as set forth in claim 13 wherein one of the rocker arms is journaled on a bearing surface formed on another of the rocker arms.

15. A cylinder head and valve arrangement as set forth in claim 13 wherein the exhaust rocker arms are each pivotally supported on a respective separate exhaust rocker arm shaft.

16. A cylinder head and valve arrangement as set forth in claim 15 further including a spark plug well formed in the cylinder head between the exhaust valves for receiving a spark plug for firing the charge within the combustion chamber.

17. A cylinder head and valve arrangement as set forth in claim 16 wherein the camshaft is provided with a separate lobe for actuating each of the rocker arms.

18. A cylinder head and valve arrangement as set forth in claim 17 wherein the camshaft is provided with a pair of spaced apart bearing surfaces each positioned axially outwardly from the cam lobes that actuate the exhaust valves.

19. A cylinder head and valve arrangement as set forth in claim 18 wherein the camshaft is further supported by a third bearing surface formed between the cam lobes that operate two of the intake valves.

20. A cylinder head and valve arrangement as set forth in claim 19 wherein at least one of the intake rocker arms extends in a plane perpendicular to a plane containing the cylinder bore axis from its respective cam lobe to the valve actuated thereby and wherein the exhaust rocker arms extends at an acute angle to said plane from the cam lobes which actuate them to the exhaust valves operated thereby.

21. A cylinder head and valve arrangement as set forth in claim 19 wherein one of the rocker arms has a portion that extends generally straight from the cam lobe to its journal portion on a rocker arm shaft and a second portion that extends from the rocker arm shaft journaled to the valve actuated thereby.

22. A cylinder head and valve arrangement as set forth in claim 17 further including a second pair of bearing surfaces formed on the camshaft between the lobes that actuate the intake rocker arms.

23. A cylinder head and arrangement as set forth in claim 13 wherein the cam shaft is provided with a separate lobe for operating each of the intake valve rocker arms and wherein the cam shaft is journaled for rotation by a bearing surface formed between at least two of the cam lobes that operate intake valves.

24. A cylinder head and valve arrangement as set forth in claim 23 wherein the cam shaft is driven at one end thereof.

25. A cylinder head and valve arrangement as set forth in claim 24 wherein the cam shaft bearing surface is separated from the driven end of the cam shaft by only one cam lobe that operates an intake valve with the cam lobes that operate the remaining intake valves being positioned on the other side of the bearing surface from the driven end of the cam shaft.

26. A cylinder head and valve arrangement as set forth in claim 23 wherein the means for rotatably journaling the cam shaft comprises a pair of bearing surfaces formed on the cam shaft each between a pair of cam lobes that operate the intake valve.

27. A cylinder head and valve arrangement as set forth in claim 23 wherein a rocker arm operating one of the intake valves from the cam lobe adjacent the bearing surface has a portion that extends generally straight from said cam lobe to its journal portion on a second rocker arm shaft and a second portion that extends at an angle from the rocker arm shaft in a direction toward the bearing surface for operating an intake valve positioned in axially alignment with the bearing surface.

* * * * *